US005470115A

United States Patent [19]

Berg et al.

[11] Patent Number: 5,470,115

[45] Date of Patent: Nov. 28, 1995

[54] RECESSED THREE-POINT LATCHING MECHANISM AND METHOD FOR A STORAGE LOCKER

[75] Inventors: Robert D. W. Berg; Eugene R. Domsten, both of La Junta, Colo.

[73] Assignee: DeBourgh Manufacturing Company, La Junta, Colo.

[21] Appl. No.: 194,704

[22] Filed: Feb. 10, 1994

[51] Int. Cl.[6] ..... E05B 63/20

[52] U.S. Cl. ..... 292/335; 292/DIG. 68

[58] Field of Search ..... 292/6, 34, 35, 292/40, 41, 153, 335, 332, DIG. 68

[56] References Cited

U.S. PATENT DOCUMENTS

| | | | |
|---|---|---|---|
| 973,001 | 10/1910 | Chruchill | 292/DIG. 68 |
| 1,515,612 | 11/1924 | O'Connor | 292/335 |
| 1,817,785 | 8/1931 | Vance | 292/DIG. 72 |
| 2,188,703 | 1/1940 | Burke | 292/DIG. 68 |
| 2,821,425 | 1/1958 | Vogt | 292/336.3 |
| 2,912,271 | 11/1959 | Schaefer | 292/336.3 |
| 3,120,748 | 2/1964 | Rechberg | 292/336.3 |
| 3,158,016 | 11/1964 | Fay | 292/DIG. 68 |
| 3,362,740 | 1/1968 | Burns | 292/34 |
| 3,742,742 | 7/1973 | Foote | 292/DIG. 68 |
| 3,843,173 | 10/1974 | Harrell | 292/DIG. 68 |
| 3,866,961 | 2/1975 | List | 292/DIG. 68 |
| 3,953,061 | 4/1976 | Hansen et al. | 292/34 |
| 4,614,374 | 9/1986 | Lannert et al. | 292/337 |

FOREIGN PATENT DOCUMENTS

| | | | |
|---|---|---|---|
| 315546 | 11/1919 | Germany | 292/335 |
| 398941 | 9/1933 | United Kingdom | 292/335 |
| 612094 | 11/1948 | United Kingdom | 292/335 |

OTHER PUBLICATIONS

DeBourgh All–American Lockers catalog/guide, "How to Select Lockers for Use . . . or Abuse," 10500/AAL, BuyLine 3093, pp. 1–16.

Frey, John S., Founder and President, Finishline Industries Lockers catalog, pp. 1–9.

*Primary Examiner*—Steven N. Meyers
*Assistant Examiner*—Tuyet-Phuong Pham
*Attorney, Agent, or Firm*—William J. Kubida; Holland & Hart

[57] ABSTRACT

A recessed three-point latching mechanism and method for a storage locker and a locker incorporating the same utilizes a dead bolt system employing a pair of rotary actuated lock rods for engaging the top and bottom of the locker door opening in conjunction with a center latch engaging the door jamb. A lever, which may include a finger grip, is utilized for simultaneously unlocking the lock rods and unlatching the center latch and is accessible within a recessed cup for safety and security. The latching mechanism and method may also include a cam to hold the latching mechanism in a door open position until the door is closed to prevent damage to the locker face by the otherwise extended lock rods. The latching mechanism and method is compatible with either padlocks or a built-in lock secured within the recessed cup.

25 Claims, 8 Drawing Sheets

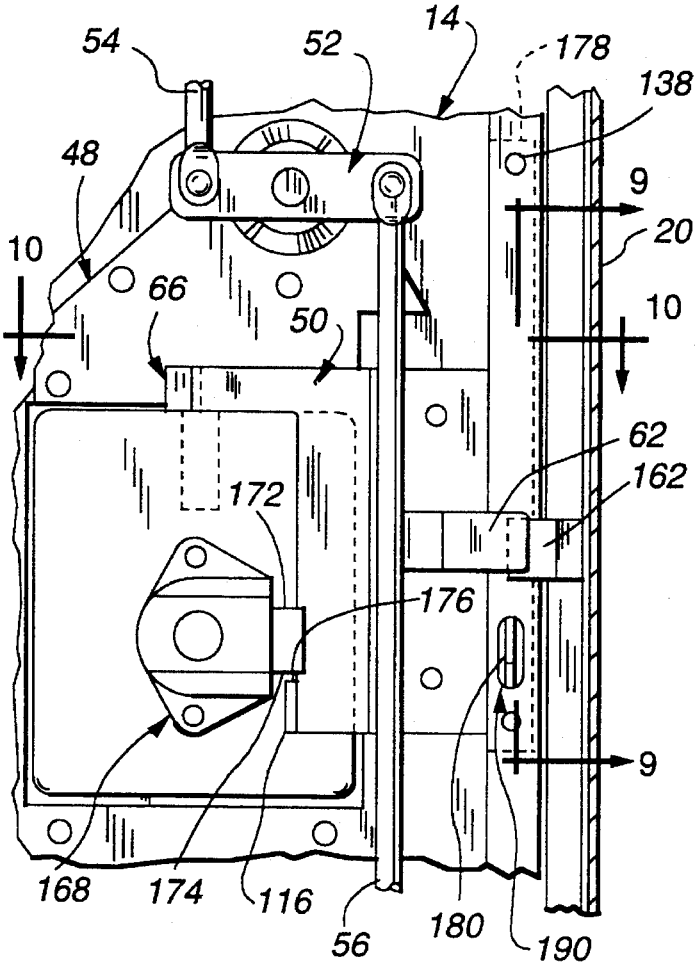
Fig. 8
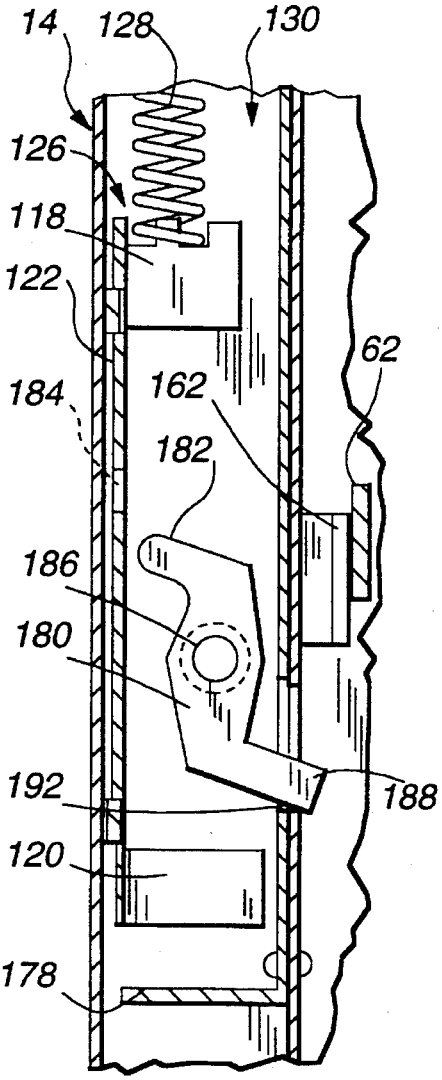
Fig. 9
Fig. 10
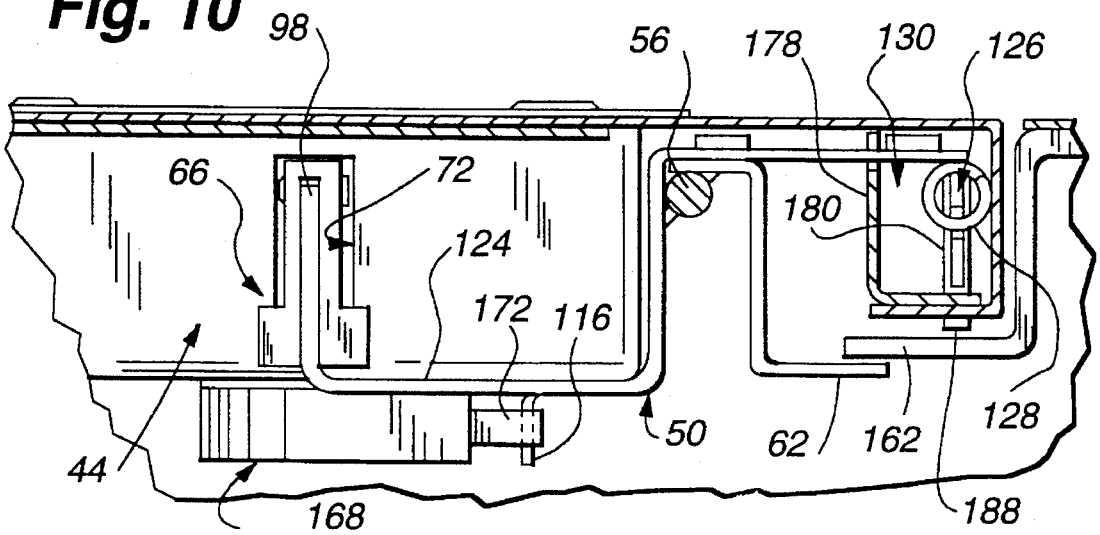

RECESSED THREE-POINT LATCHING MECHANISM AND METHOD FOR A STORAGE LOCKER

BACKGROUND OF THE INVENTION

The present invention relates, in general to a latching mechanism and method and a storage locker incorporating the same. More particularly, the present invention relates to a recessed three-point latching mechanism and method for a storage locker which utilizes a dead bolt system employing a pair of rotary actuated lock rods for engaging the top and bottom of the locker door opening in conjunction with a center latch engaging the door jamb. By means of an externally accessible lever, an individual may simultaneously unlock the lock rods and unlatch the center latch to open the locker door. The lever or finger grip is accessible within a recessed cup for safety and security. A particular embodiment incorporates a cam to hold the latching mechanism in an open or unlatched position until the door is closed to prevent damage to the locker face by the otherwise extended lock rods.

Many lockers, cabinets or similar locker enclosures now include a recessed pocket or cup within the enclosure door to contain the lock mechanism for both user safety and security purposes. However, such recessed lock mechanisms are generally of the spring loaded type that simply engage the door jamb at one or more points thereby providing limited strength and security to the locker. While these "gravity type" mechanisms are capable of enabling the user to relock the door while it is still open, the sliding channel-or spring clips which form the locking mechanism are easily defeated by picking, particularly in lockers with perforated (or mesh) sides or doors which are often used to provide ventilation to the contents of the locked enclosure.

In general, these gravity type or spring loaded latches consist of a lifting handle in conjunction with a stationary lock lug. When utilized in conjunction with a recessed pocket or cup, a finger latch protrudes down through the top of the cup having a hole for a padlock which, when inserted, prevents the latch from being lifted as the lock shackle contacts the top of the recessed cup. The lifting latch forms part of a bracket which is formed around the back side of the cup and engages a sliding channel which, in turn, slides within a channel formation of the door on the jamb side. Holes may be provided in the recessed cup for mounting built-in locks if desired and which also engage the latch on the back of the cup. Two or more latching hooks may be provided on the door jamb which, in turn, engage the locker door and sliding channel through slots in the door flange and sliding channel. A taper on the latching hooks is utilized to force the sliding channel up and over the hook thus latching the door. When the latch is lifted, the sliding channel clears the latch hook and the door can be opened. Alternatively, spring clips may sometimes be used to provide latching at the hooks without moving the entire sliding channel for closing. As stated previously, the advantage of the gravity, or spring latch type, doors is that the user can open the door and lock it again immediately before closing since there is no physical attachment to the lock latch in the sliding channel. As previously noted, the major disadvantage is that such lock mechanisms can be easily picked, particularly if used on open panel type lockers.

An alternative locking technique includes the use of a rotary or turn handle type mechanism to actuate locking rods engaging the door at the top, bottom as well as latching at the door jamb. These type of mechanisms are generally referred to as the "dead bolt" type and have the significant advantage of being extremely difficult, if not impossible, to pick through the sides of an open type locker or to otherwise pry the enclosure door open from the top or the bottom. A significant problem with the use of the rotary or turn handle type mechanisms is that they cannot be completely recessed in a door cup without requiring a recessed pocket or cup sufficiently large to enable rotation of the handle. Such a large recessed cup would be aesthetically unpleasing and possibly even weaken the structure of the enclosure door. Concomitantly, such a recessed rotary mechanism would require that the internal mechanism of the latch extend to an undesirably great depth into the locker due to the fact that it would be mounted on the back of the recessed cup.

DeBourgh Manufacturing Company, La Junta, Colorado, assignee of the present invention, has been manufacturing non-recessed, three-point dead bolt latch mechanisms for use on its mesh type athletic lockers for over 60 years. Because athletic and physical education lockers typically require much air movement for drying and ventilation, they are constructed with door and/or side panels of mesh or perforations. Unlike the gravity type, or sliding channel mechanisms, the dead bolt is relatively impervious to picking through the side or door of the locker.

Conventionally, the non-recessed, three-point dead bolt latch currently in use consists of a heavy bar handle with one end formed 90° and pierced for a padlock. A lock lug with a corresponding hole is welded to the door adjacent to the formed end. A handle pin is welded roughly in the center of the handle which, in turn, is mounted through a handle pin tube which is also secured to the door. A latching bar is welded horizontally to the handle pin which projects through the handle pin tube and door panel. On each side of the pivot point, at a suitable distance, are holes to which two latching rods are secured with steel rivets, which are also welded to the latching bar. The latching rod closest to the hinges projects upward through a rod guide and door frame into a hole in the locker top flange. On the other hand, the other latching rod on the door jamb side projects downward in the same manner engaging a hole in the locker bottom. When the handle is rotated clockwise, both latching rods are retracted and the door can be opened. Conversely, when the door is closed and the handle is rotated counterclockwise, the latching rods secure the door at the top and the bottom. Stops may be provided for the latching bar to limit rotation in both directions. One side of the latching bar is notched 90° to provide a locking point for a standard built-in dead bolt lock should it be desired over a padlock.

SUMMARY OF THE INVENTION

The present invention relates to an improved recessed three-point latching mechanism and method for a storage locker which incorporates the benefits of the lift type recessed latch of the gravity type mechanisms with the three-point dead bolt type latch previously provided only by means of a surface mounted rotary or a turn handle type mechanism. Thus, the benefits of a recessed lift type latch are combined with the security of a three-point dead bolt system. The recessed cup of the latch of the present invention includes a finger lift latch and hasp bracket which provides for an external padlock or a built-in lock. The hasp bracket, instead of engaging a sliding channel as in prior art techniques, is welded to the lower locking rod and further formed to engage the door stop or flange on the door jamb. The upper end of the lock rod is attached to a pivot bar pivoting in the center and attached to the top lock rod in similar fashion to the three-point dead bolt system. The pivot bar is secured to a pivot plate with built-in rotation stops and secured to the door by the same fasteners used for the recessed cup and external locker number plate. Inasmuch as the lower lock rod is longer than the top, the latch mechanism is maintained in a normally closed or locked position due to the extra weight of the lower lock rod. As a consequence, the latch mechanism may lock when the locker door is opened and the latch may have to be lifted to again unlock the latch mechanism before closing the door or the locker face might be marred by the protruding lock rods. A spring loaded cam may be incorporated into the channel formation on the jamb side of the door and is designed to engage a bracket notch in the hasp bracket thus holding it up, or in the unlocked position. The opposite end of the cam protrudes through an aperture in the door flange and when the door is shut, the opposite end engages the door stop or flange thereby pivoting the cam to release the latch mechanism by gravity and/or spring assistance.

Specifically provided herein is a latching mechanism for an enclosure formed of a generally box-like interior compartment with a hingedly attached door having inner and outer surfaces thereof and a periphery surrounded by upper, lower and jamb portions of the enclosure. The door includes a recessed cup communicating between the inner and outer surfaces of the door and is displaced inwardly into the interior compartment from the plane of the door. The latching mechanism comprises an exposed lever disposed within the recessed cup, the lever communicating with the interior compartment of the enclosure. A bracket is actuatable by the lever and is movably retained adjacent to the interior surface of the door. The bracket includes a center latch having a first latched position thereof for engaging the jamb portion of the enclosure and a second unlatched position thereof for disengaging the center latch from the jamb portion of the enclosure. A pivot bar is pivotally secured about a substantially median point thereof adjacent the interior surface of the door. The pivot bar is coupled to the bracket for transforming a motion of the bracket induced by the lever to a rotational motion of the pivot bar. At least two radially extending lock rods are pivotally affixed at proximal ends thereof adjacent opposite ends of the pivot bar for transforming a rotational motion of the pivot bar to a translational motion of the lock rods. The lock rods have a first locked position thereof in conjunction with the first latched position of the center latch for engaging the upper and lower portions of the enclosure adjacent a distal end of the lock rods. The lock rods also have a second unlocked position thereof in conjunction with the second unlatched position of the center latch for disengaging the distal end of the lock rods from the upper and lower portions of the enclosure.

The latching mechanism may further include a cam in operative association with the bracket and the door wherein the cam has a first door open position thereof for releasably retaining the center latch in the second unlatched position thereof and the lock rods in the second unlocked position thereof when the door is opened. The cam also has a second door close position thereof allowing the center latch to move to the first latched position thereof and the lock rods to move to the first locked position thereof when the door is closed.

DESCRIPTION OF THE DRAWINGS

The above mentioned, and other features and objects of the present invention and the manner of attaining them will become more apparent and the invention itself will be best understood by reference to the following description of a preferred embodiment taken in conjunction with the accompanying drawings wherein:

FIG. 8 is a partially cutaway rear plan view of a portion of the latching mechanism of the present invention when in the closed or latched position thereof;

FIG. 9 is a cutaway side plan view of the portion of the latching mechanism illustrated in FIG. 8 taken substantially along section line 9—9 thereof and showing the cam which is utilized for maintaining the latching mechanism in the unlatched or open position when the locker door is opened and illustrating the cam in the position it would maintain when the latching mechanism is in the latched position thereof;

FIG. 10 is a cutaway top plan view of the latching mechanism of FIG. 8 taken substantially along section line 10—10 thereof and illustrating the interrelationship of the latching mechanism with the locker door and door jamb adjacent the center latch;

DESCRIPTION OF A PREFERRED EMBODIMENT

Figure 1:
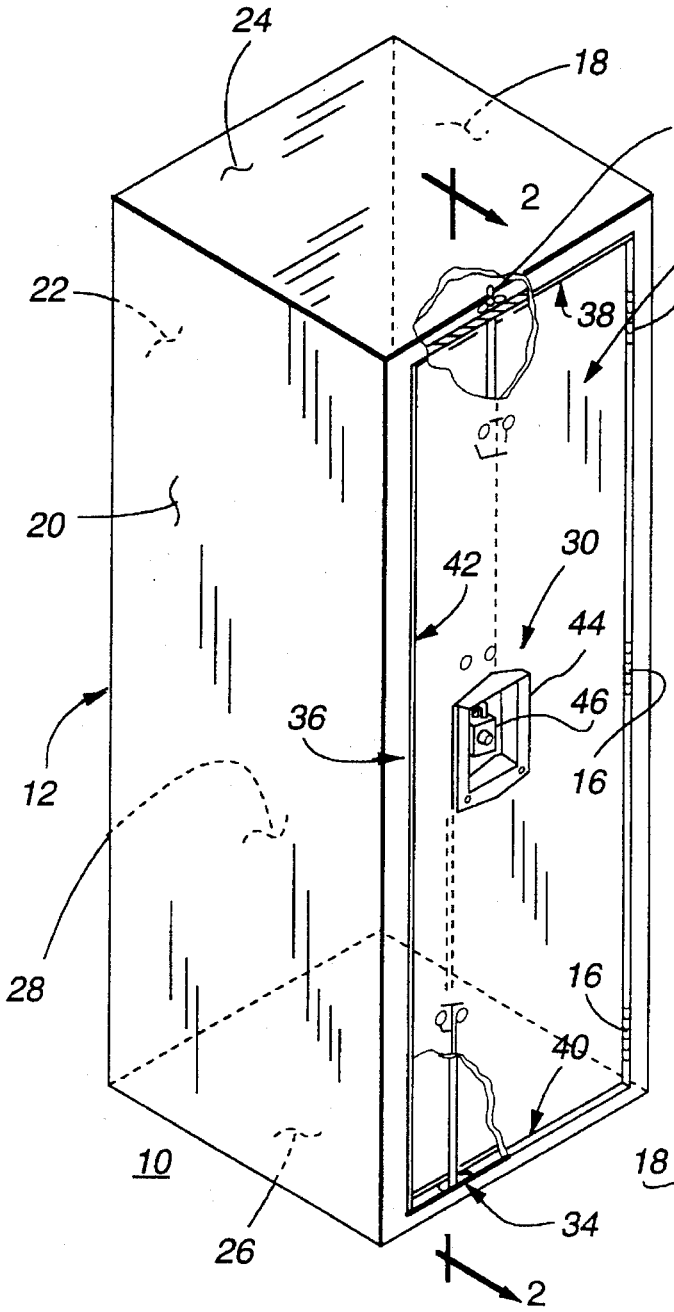
FIG. 1 is a partially cutaway, isometric view of a storage locker incorporating a recessed three-point latching mechanism in accordance with the present invention and generally illustrating the upper, lower and side locking points thereof.

With reference now to FIG. 1, a storage locker 10 is shown comprising, in pertinent part, a box 12 having a door 14. Door 14 is hingedly affixed along one edge thereof by means of a number of hinges 16 to a peripheral lip surrounding the opening to box 12.

The locker 10 includes a hinge side panel 18 and generally parallel and oppositely disposed latch side panel 20. A back panel 22 interconnects hinge side panel 18 and latch side panel 20 in conjunction with an upper panel 24 and bottom panel 26. While the various panels making up box 12 of locker 10 are shown as being made of a non-perforated sheet material, the panels may also be furnished as a perforated or mesh material to allow ventilation through the locker 10. Locker 10, comprising box 12 and door 14 then defines an interior space 28 for storage of items in a secured fashion within the locker 10.

Figure 2:
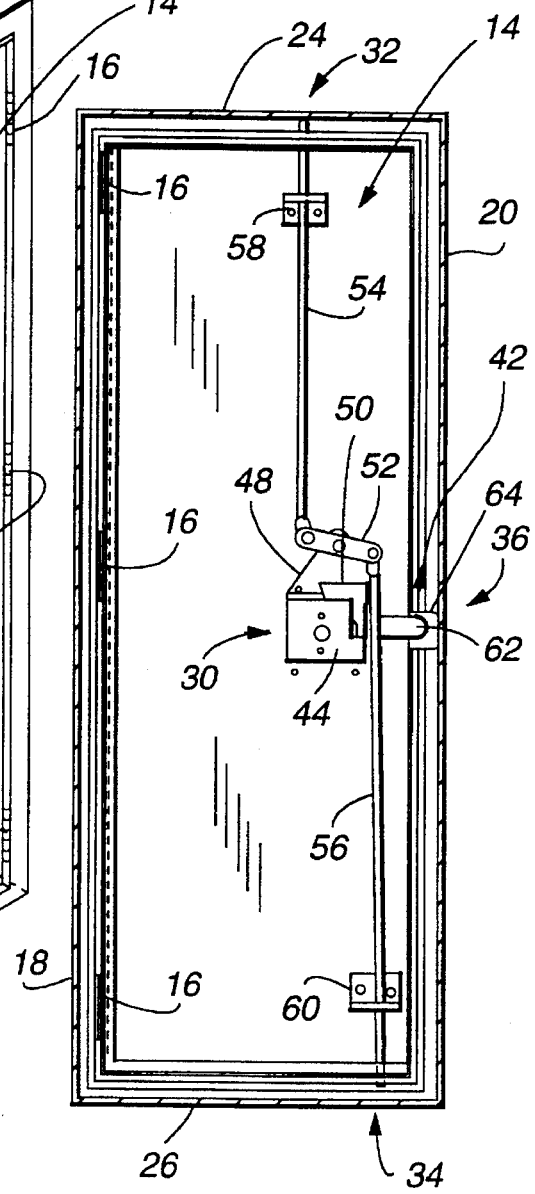
FIG. 2 is a rear plan view of the storage locker of FIG. 1 taken substantially along section line 2—2 thereof illustrating the interior of the locker door and showing the latching mechanism inclusive of the upper and lower lock bars and center latch.

Referring additionally now to FIG. 2, the latch mechanism 30 of the present invention is shown. Latch mechanism 30, when used in conjunction with a locker 10, provides a three-point latching mechanism for securing the door 14 to the box 12 at an upper locking point 32, a lower locking point 34 and a side locking point 36. Upper locking point 32 is adjacent the upper door opening 38 at the peripherally surrounding lip of the box 12 and the upper edge of the door 14. Similarly, the lower locking point 34 is defined at the peripheral surrounding lip of the box 12 at the lower door opening 40 and the lower edge of the door 14. The side locking point 36 is defined at the peripheral surrounding lip of the door opening adjacent the latch mechanism 30 at the door jamb 42 in conjunction with the corresponding portion of the door 14 edge.

Latch mechanism 30 comprises a recessed cup 44 communicating between the outer surface and inner surface of the door 14. The recessed cup 44 allows for the recessed mounting of, for example, a removable padlock 46 or built-in lock as will be more fully described hereinafter. The recessed cup 44 allows access for manual activation of the latch mechanism 30 of the locker 10 without presenting any outwardly extending protrusions to the door 14 which might become damaged or cause injury to an individual who encounters the locker 10. With particular reference to FIG. 2, the latch mechanism 30 is shown to comprise, in addition to the recessed cup 44, a pivot plate 48 which is secured adjacent to the inner surface of the door 14 as shown. A hasp bracket 50 is movably retained adjacent the interior of the recessed cup 44 and a lateral motion may be imparted to it by an individual through the externally facing concave portion of the recessed cup 44.

A pivot bar 52 is pivotally secured to the pivot plate 48 and has the upper lock rod 54 and lower lock rod 56 pivotally connected adjacent ends thereof. The upper lock rod 54 extends from the pivot bar 52 through a rod guide 58 and the lower lock rod 56 extends from the opposite end of the pivot bar 52 through a rod guide 60 as shown center latch 62 interacts with a door stop 64 affixed adjacent the door jamb 42 of the box 12 as shown.

Figure 3:
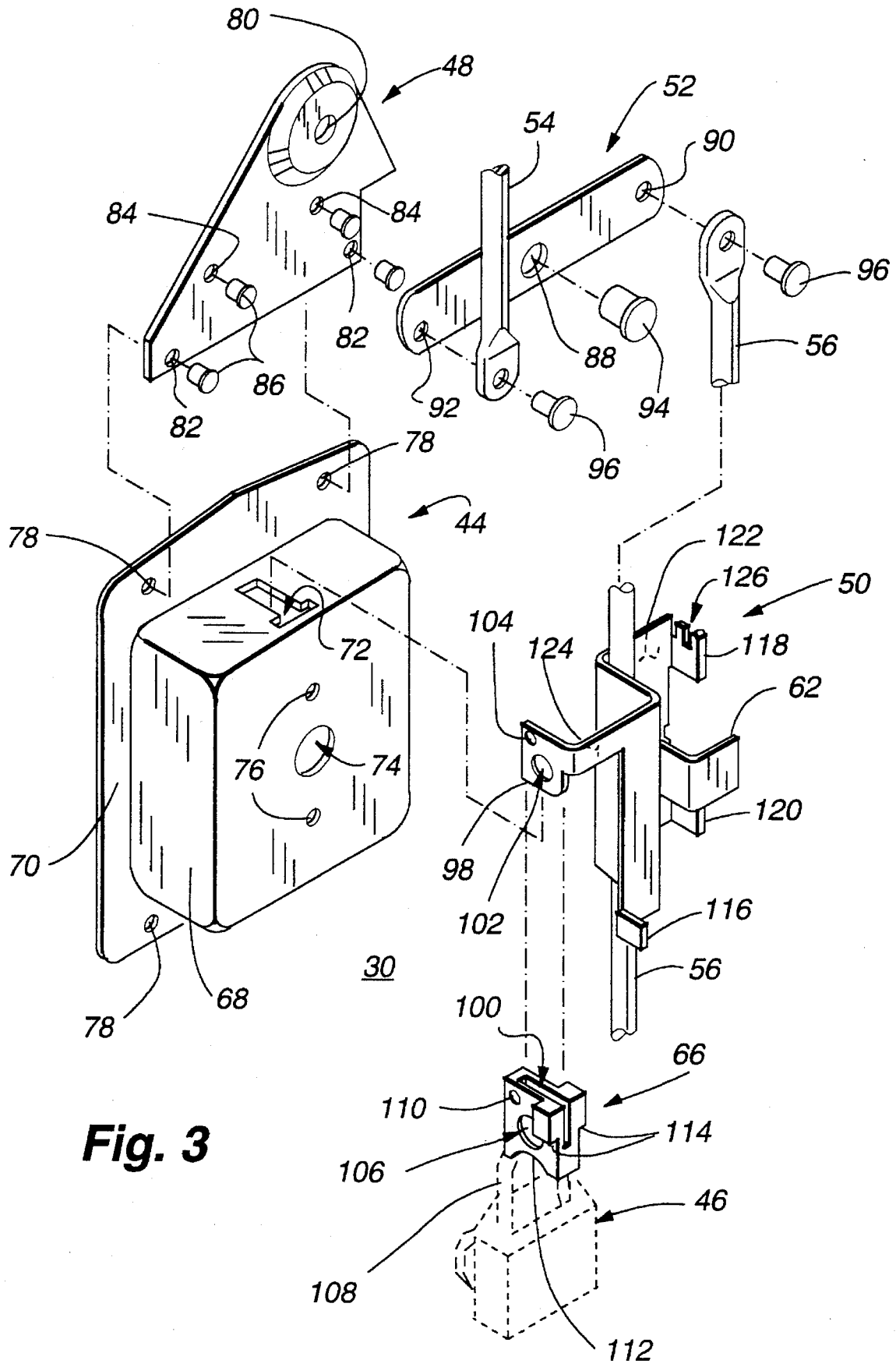
FIG. 3 is an exploded view of a portion of the latch mechanism of the preceding figures illustrating the interrelationship of the recessed cup, pivot plate, pivot bar, hasp bracket and finger lift or lever.

Referring additionally now to FIG. 3, the primary components of the latch mechanism 30 of the present invention are shown in an exploded view to better illustrate their interconnection and respective elements. Recessed cup 44 includes a cup portion 68 which extends within the interior space 28 defined by the box 12 and door 14. The cup portion 68 extends through a generally square aperture within a locker 10 door 14 to allow an individual to externally manipulate the latch mechanism 30 while the door 14 is closed.

The recessed cup 44 additionally includes a flange 70 which peripherally surrounds the lip of the cup portion 68. The flange 70 is mounted adjacent the outer face of the door 14 and surrounds the generally square hole through the structure of the door 14 through which the cup portion 68 is inserted. Cup portion 68 includes a lever aperture 72 through an upward facing surface thereof to allow for manipulation of the latch mechanism 30 as will be more fully described hereinafter. Cup portion 68 also may include a built-in lock hole 74 and lock mounting holes 76 which allow for securing a built-in combination lock accessible from the outside of the locker 10 as will be more fully described hereinafter. The recessed cup 44 may be secured to the door 14 using a number of fasteners (not shown) extending through the cup mounting holes 78 provided in flange 70.

Pivot plate 48 includes a hole defining a pivot point 80 for pivotally securing the pivot bar 52 thereto. Pivot plate 48 may be affixed to recessed cup 44 and door 14 by means of a number of fasteners (such as rivets, screws or the like) extending through mounting holes 82 and cup mounting holes 78 of recessed cup 44. Additionally, a number of mounting holes 84 may likewise be provided to secure the pivot plate 48 to the interior surface of door 14. A notch in the pivot plate 48 adjacent the mounting holes 82, 84 may serve as a physical "stop" to provide an upper limit of travel to the hasp bracket 50.

Pivot bar 52 comprises a generally centrally located pivot hole 88 as well as a lower lock rod pivot point 90 adjacent one end thereof and an opposite upper lock rod pivot point 92 adjacent an opposite end thereof. Pivot bar 52 is pivotally secured to pivot point 80 of pivot plate 48 by means of a fastener 94 extending through pivot hole 88 of pivot bar 52 and secured within the hole defining the pivot point 80 of the pivot plate 48. As shown, one of the fasteners 96 extends through a hole adjacent a proximal end of upper lock rod 54 to pivotally secure upper lock rod 54 to one end of pivot bar 52 by securing the fastener 96 within the hole defining the upper lock rod pivot point 92. In like manner, a fastener 96 is inserted through a hole adjacent a proximal end of lower lock rod 56 and is secured within the hole defining the lower lock rod pivot point 90 as shown.

Hasp bracket 50 includes a tab 98 which extends through lever aperture 72 of the cup portion 68 of the recessed cup 44. The tab 98 extends into, and is secured within, a tab slot 100 of the finger lift (or lever) 66. Tab 98 includes a shackle hole 102 and a mounting hole 104 as shown. In like manner, finger lift 66 includes a corresponding shackle hole 106 to allow for the insertion of a padlock 46 shackle 108 through finger lift 66 and tab 98. Finger lift 66 may be secured to tab 98 by means of a fastener (not shown) inserted within mounting hole 110 of finger lift 66 and into the corresponding mounting hole 104 of tab 98 of the hasp bracket 50.

Finger lift 66 also includes a finger channel 112 which is accessible by a user within the externally facing concave portion of the recessed cup 44. With finger lift 66 inserted such that the finger channel 112 extends through the lever aperture 72, the finger lift 66 interacts with the cup portion 68 such that the collars 114 rest upon the upper surface of the cup portion 68 adjacent the lever aperture 72. With, for example, a padlock 46 secured to the finger lift 66, and, in turn, to the hasp bracket 50 tab 98, the shackle 108 of the padlock 46 will interact with the interior concave surface of the recessed cup 44 to prevent the finger lift 66 from being raised to manipulate the latch mechanism 30. In this manner, the padlock 46 must be taken off by removing the shackle 108 from the finger lift 66 in order to allow upward pressure applied to the finger channel 112 to cause a concurrent translational motion of the hasp bracket 50 of the latch mechanism 30.

Hasp bracket 50 also includes a bolt tab 116 which interacts with a built-in lock as will be more fully described hereinafter which may be used in lieu of the padlock 46. Hasp bracket 50 also includes an upper channel tab 118 and corresponding lower channel tab 120 for guiding the translational motion of the hasp bracket 50 within the door channel of door 14 as will be more fully described hereinafter. Hasp bracket 50 moves in response to pressure applied to tab 98, causing its door surface 122 to move parallel to the interior surface of door 14. Concurrently, translational motion of the hasp bracket 50 causes the cup surface 124 to move in a parallel and spaced apart relationship to the inward facing surface of the recessed cup 44. As will be more fully described hereinafter, the upper channel tab 118 also includes a spring retaining edge 126 for use with a compression spring to ensure a positive latching of the latch mechanism 30.

Figure 4:
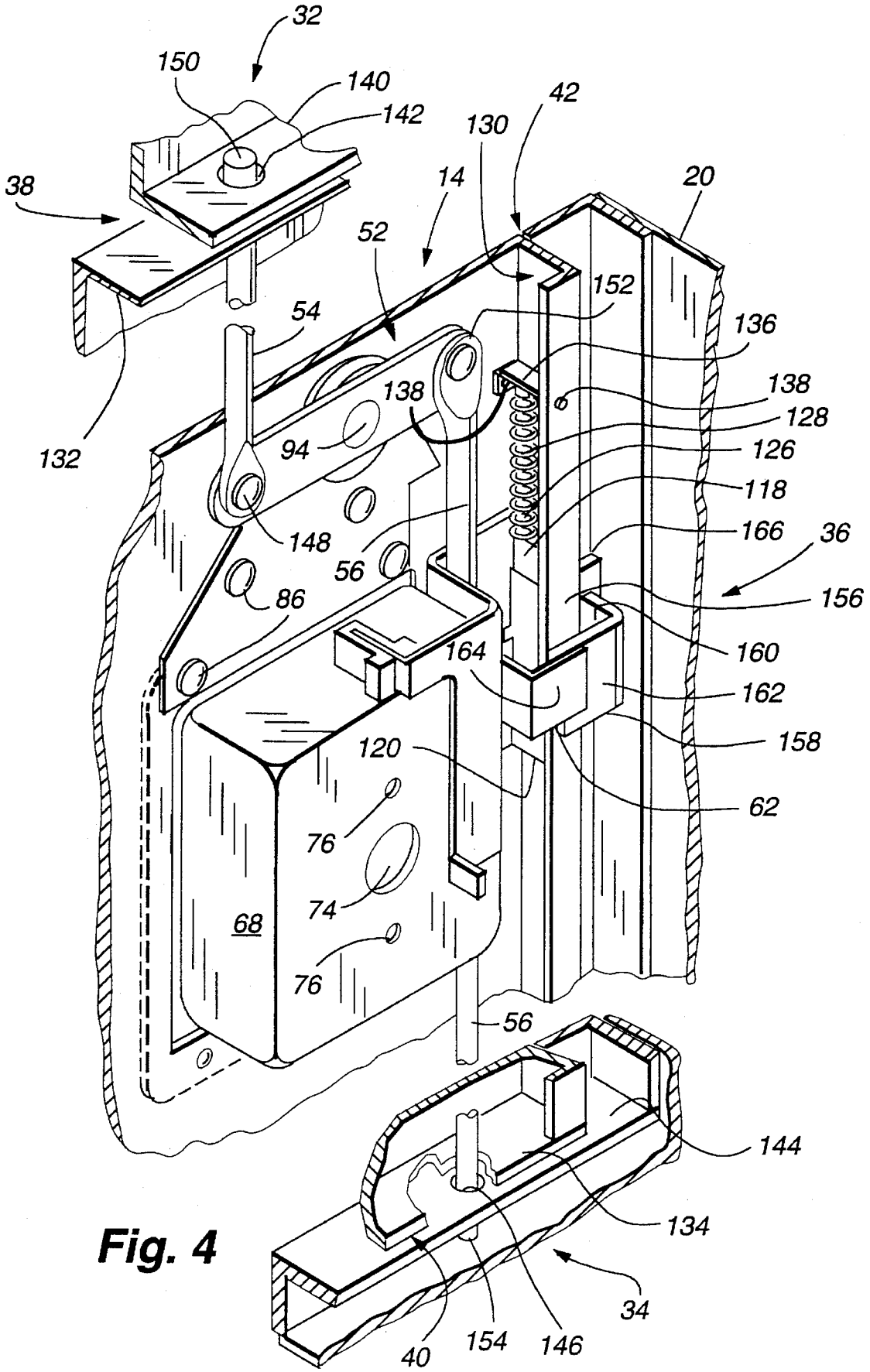
FIG. 4 is a cutaway, isometric view of the latch mechanism of the preceding figures showing in greater detail the three-point latching configuration of the upper and lower lock rods and center latch when in the locked position thereof.

Referring additionally now to FIG. 4, the latch mechanism 30 of the present invention is shown wherein the latch mechanism is in the locked position with the door 14 of the locker 10 closed. In this illustration, like structure to that previously described with respect to the preceding figures is like numbered and the foregoing description thereof shall suffice herefore.

The latch mechanism 30 is generally maintained in a normally closed, or latched position, by means of the weight of the lower lock rod 56 which is attached (for example, by welding) to the hasp bracket 50. Since the lower lock rod 56 is generally longer than the upper lock rod 54, and hence, heavier, the weight of lower lock rod 56 maintains the hasp bracket 50 in its downward most position. In this manner, the latch mechanism 30 causes the door to be secured at the upper locking point 32, the lower locking point 34 and the side locking point 36. In addition, a compression spring 128 which is positioned within the door channel 130 of the door 14 causes a downward pressure to be applied to the upper channel tab 118 at its spring retaining edge 126 to maintain an additional slight bias to the latch mechanism 30 to maintain it in the closed or latched position when subjected to rapid latching. The compression spring 128 is maintained within the door channel 130 between a spring retainer 136 and the spring retaining edge 126 of the upper channel tab 118. The spring retainer 136 is secured within the door channel 130 by means of a number of spring retainer fasteners 138.

The door 14 includes an upper door lip 132 which, in conjunction with the upper door opening lip 140 comprises a portion of the upper door opening 38. The upper door opening lip 140 is a portion of the box 12 peripherally surrounding the door 14 at the upper edge thereof. The upper door opening lip 140 includes a lock rod hole 142 which corresponds to a hole through the upper door lip 132 (not shown) through which the distal end 150 of the upper lock rod 54 extends when the latch mechanism 30 is in the closed or latched position.

In like manner, the door 14 includes a lower door lip 134 which adjoins a lower door opening lip 144 of the box 12 peripherally surrounding the door 14 at the lower edge thereof. The lower door lip 134 includes a hole corresponding to the lock rod hole 146 of the lower door opening lip through which the distal end 154 of the lower lock rod 56 extends when the latch mechanism 30 is in the closed, or locked position thereof. When in this position, the upper lock rod 54 extends from a pivotally mounted proximal end 148 affixed to pivot bar 52 to a distal end 150 at the upper locking point 32. In like manner, the lower lock rod 56 extends from a proximal end 152 pivotally secured to the pivot bar 52 to a distal end 154 at the lower locking point 34.

The side locking point 36 is established by the interaction of the center latch 62 secured to (for example, by welding), or formed as a part of, the hasp bracket 50 in conjunction with one or more door stop tabs 158. When the door 14 of the locker 10 is closed, the inner door channel surface 156 adjoins and interacts with a door channel surface 160 of the door stop tab 158. Additionally, when in the closed or latched, position thereof the center latch 62 interacts with and adjoins the door latch surface 162 of the door stop tab 158 at the door stop surface 164 of the center latch 62. In this manner, the door 14 is prevented from rotating too far within the interior space 28 of the locker 10 by means of the door stop tab 158. Additionally, the interaction of the door stop tab 158 with the center latch 62 provides a third point for securing the door 14 in a closed, or locked, position by means of the latch mechanism 30 of the present invention.

As shown in this figure, a single door stop tab 158 may be utilized to establish the side locking point 36 in conjunction with the center latch 62 by securing the door stop tab 158 at a door jamb latch point 166.

Figure 5:
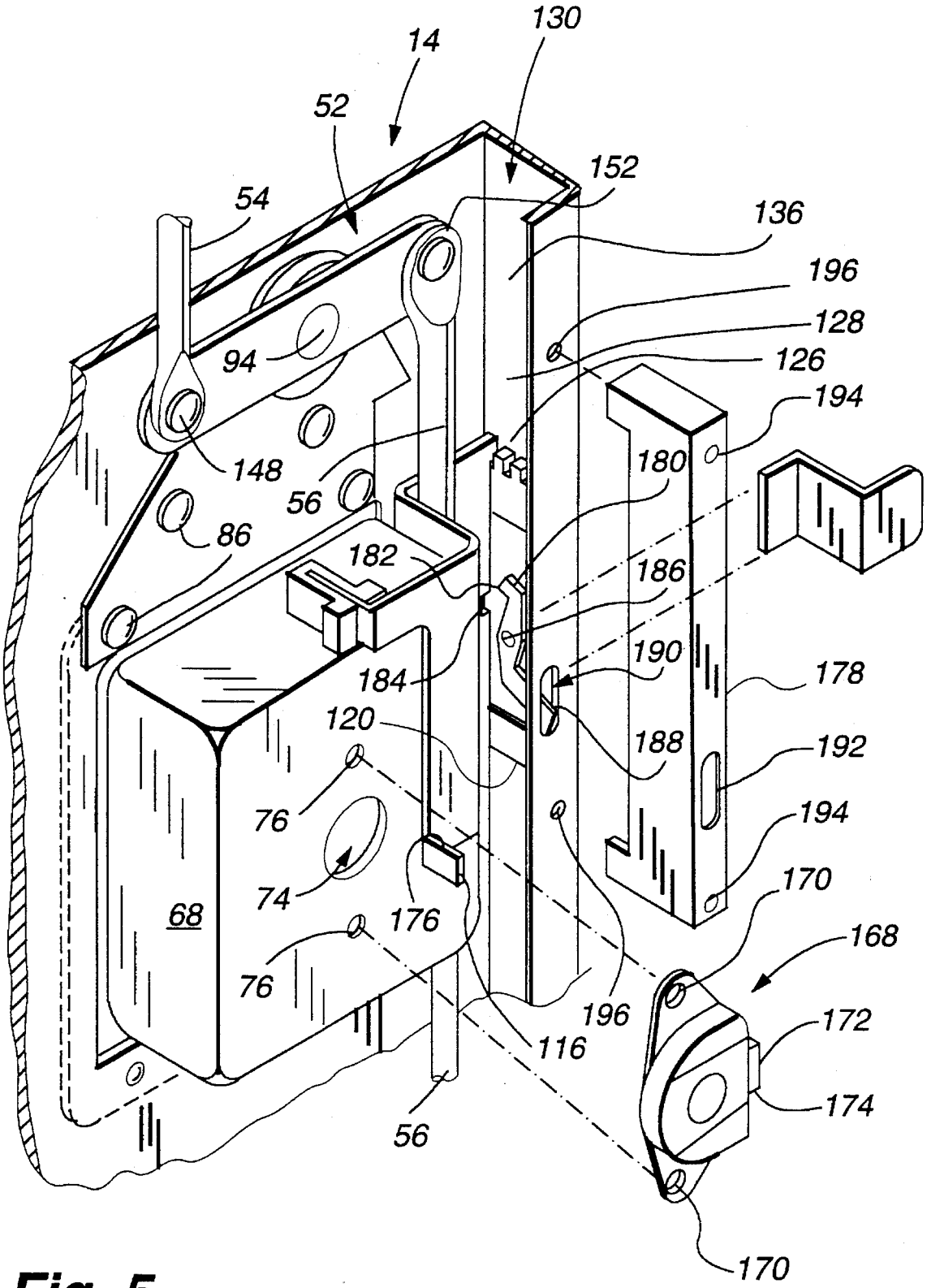
FIG. 5 is a cutaway, isometric view of the latch mechanism of the preceding figures further illustrating the latching mechanism in conjunction with a built-in lock and showing the cam and cam cover for holding the latching mechanism in an open or unlocked, condition while the locker door is open to preclude marring of the locker surfaces by the otherwise extended lock rods and center latch when the door is pushed closed.

Referring additionally now to FIG. 5, the latch mechanism 30 of the present invention is shown in conjunction with a built-in lock 168 and a cam 180 for holding the latch mechanism 30 in an open, or unlatched position, when the door 14 of the locker 10 is opened. With respect to this illustration, corresponding structure to that previously described with respect to the preceding figures is like numbered and the foregoing description thereof shall suffice herefore.

The latch mechanism 30 of the present invention may be utilized in conjunction with a built-in lock 168 as shown in lieu of the external padlock 46 secured through the shackle hole 106 of the finger lift 66 shown in FIG. 3. When utilized in conjunction with a built-in lock 168, the lock mechanism may be secured by means of fasteners (not shown) extending through mounting holes 170 and into lock mounting holes 76 of the recessed cup 44. In a particular embodiment, the built-in lock 168 may comprise a Master model 1630 combination lock. The built-in lock 168 is accessed through the concave portion of the recessed cup 44 as with the external padlock 46. However, the bolt 172 extending from the built-in lock 168 interacts with the hasp bracket 50 by means of the lower surface 174 of bolt 172 coming into contact with the upper edge 176 of the bolt tab 116. In this manner, when the bolt 172 of the built-in lock 168 is extended, the hasp bracket 50, and hence the latch mechanism 30, is precluded from leaving the locked, or closed, position in response to upward pressure applied by an individual to the finger lift 66.

Also illustrated in this figure is a cam 180 which is utilized to maintain the latch mechanism 30 in an open, or unlatched position once the door 14 of the locker 10 is opened. This feature is useful in precluding damage to the locker 10 surfaces adjoining the upper locking point 32 and lower locking point 34 due to the extension of the upper lock rod 54 and lower lock rod 56 respectively when the door 14 is opened and the latch mechanism 30 is allowed to return to its normally closed or locked position prior to closing of the door 14. Should the door 14 be shut while the upper lock rod 54 and lower lock rod 56 are extended, the locker 10 may be damaged. In like manner, the center latch 62 is held in an unlatched or open position by means of the cam 180.

Figure 12:
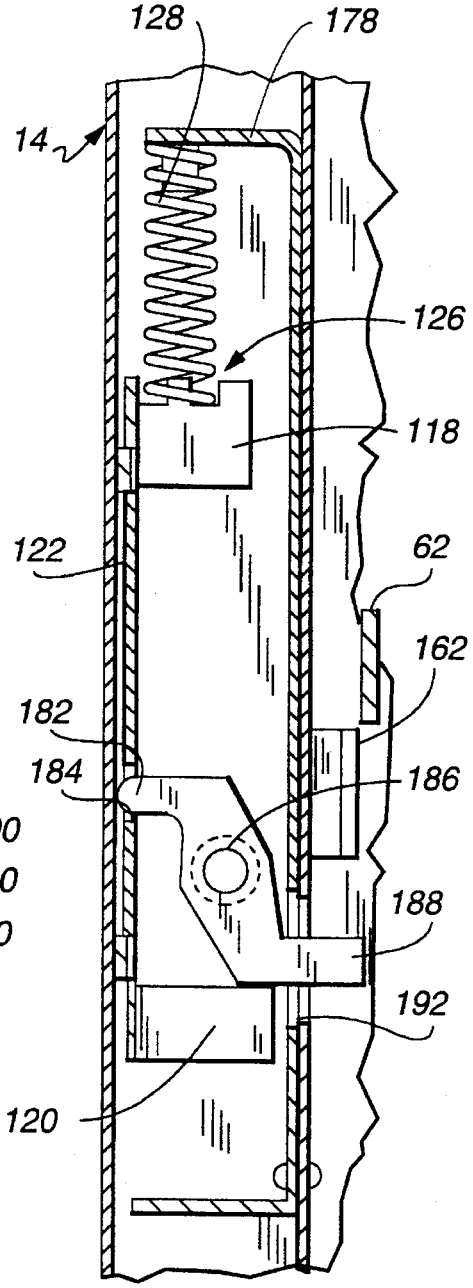
FIG. 12 is a cutaway side plan view of the portion of the latching mechanism shown in FIG. 11 taken substantially along section line 12—12 thereof and illustrating the cam for holding the latching mechanism in the open position by means of, for example, a coil spring biasing the cam toward engagement with the bracket notch until such time as the jamb tab portion of the cam interacts with the locker door jamb causing the cam to disengage from the bracket notch allowing the latching mechanism to return to the locked condition as biased by gravity and a compression spring as shown.

When the hasp bracket 50 of the latch mechanism 30 is moved upward in response to pressure applied to the finger lift 66, the cam 180, as biased by a coil spring (not shown) is rotated towards the interior surface of the door 14 such that the bracket tab 182 aligns with and is inserted into the bracket notch 184 and the hasp bracket 50 as shown more fully in FIG. 12. Concurrently, the cam 180 has a jamb tab 188 which protrudes through door channel aperture 190 such that, since the cam 180 is pivoted about pivot mount 186, interaction of the door jamb with the jamb tab 188 will cause a rotation of the cam 180 opposing the bias of the coil spring to release the bracket tab 182 from the bracket notch 184 (see FIG. 9) allowing the hasp bracket 50 of the latch mechanism 30 to descend to its normally closed or latched position in response to the weight of the lower lock rod 56 and the bias of the compression spring 128 illustrated in FIG. 4. A cam cover 178 may be utilized in conjunction with the cam 180 and is inserted within the door channel 130 and secured therein by means of a number of fasteners (not shown) extending through holes 194 and 196. When utilized in conjunction with a cam cover 178, a cover aperture 192 generally coextensive with the door channel aperture 190 will be provided to allow interaction between the jamb tab 188 of the cam 180 and the door jamb 42 when the door 14 is closed.

Figure 6:
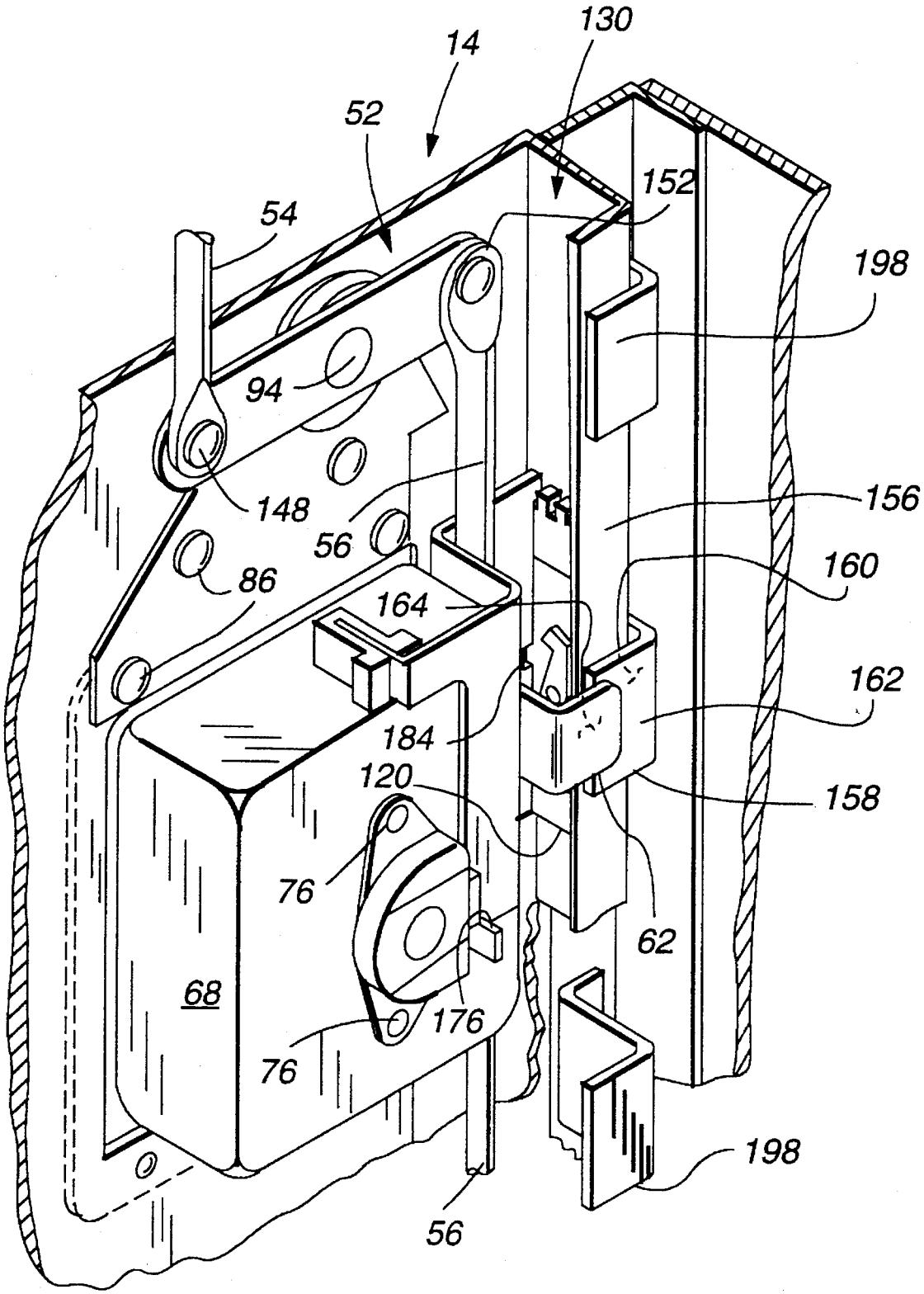
FIG. 6 is an additional cutaway, isometric view of the latch mechanism of the preceding figures showing the use of the latching mechanism and center latch in conjunction with a number of individual door stops along the door jamb.

Referring additionally now to FIG. 6, the latch mechanism 30 of the preceding figures is shown in conjunction with a number of individual discontinuous door stops comprising door stop tab 158 and additional door stops 198. With respect to this illustration, structure previously described with respect to the preceding figures is like numbered and the foregoing description thereof shall suffice herefore.

Figure 11:
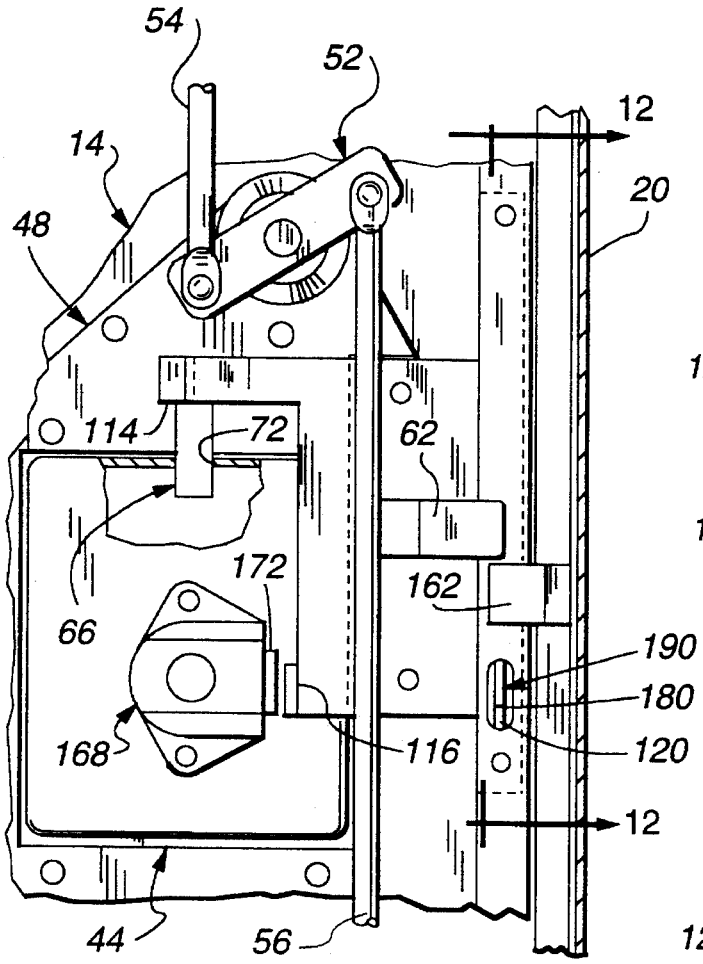
FIG. 11 is an additional cutaway rear plan view of the latching mechanism of FIG. 8 showing the latching mechanism in the open position thereof whereby the lock bars are retracted from the upper and lower locking points adjacent the upper and lower door openings respectively and the center latch is moved laterally away from engagement with the door stop to allow the locker door to swing open.

In this illustration, the center latch 62 is shown as adjoining the door latch surface 162 of the door stop tab 158 when the latch mechanism 30 is in the closed or latched position thereof. As an individual applies pressure to the finger lift 66 (not shown) the hasp bracket 50 will move upward to a point where the center latch 62 clears the upper edge of the door stop tab 158 (as shown in FIG. 11) and, in conjunction with the retraction of the upper lock rod 54 and lower lock rod 56 (not shown) the door 14 of the locker 10 may be opened.

Figure 7:
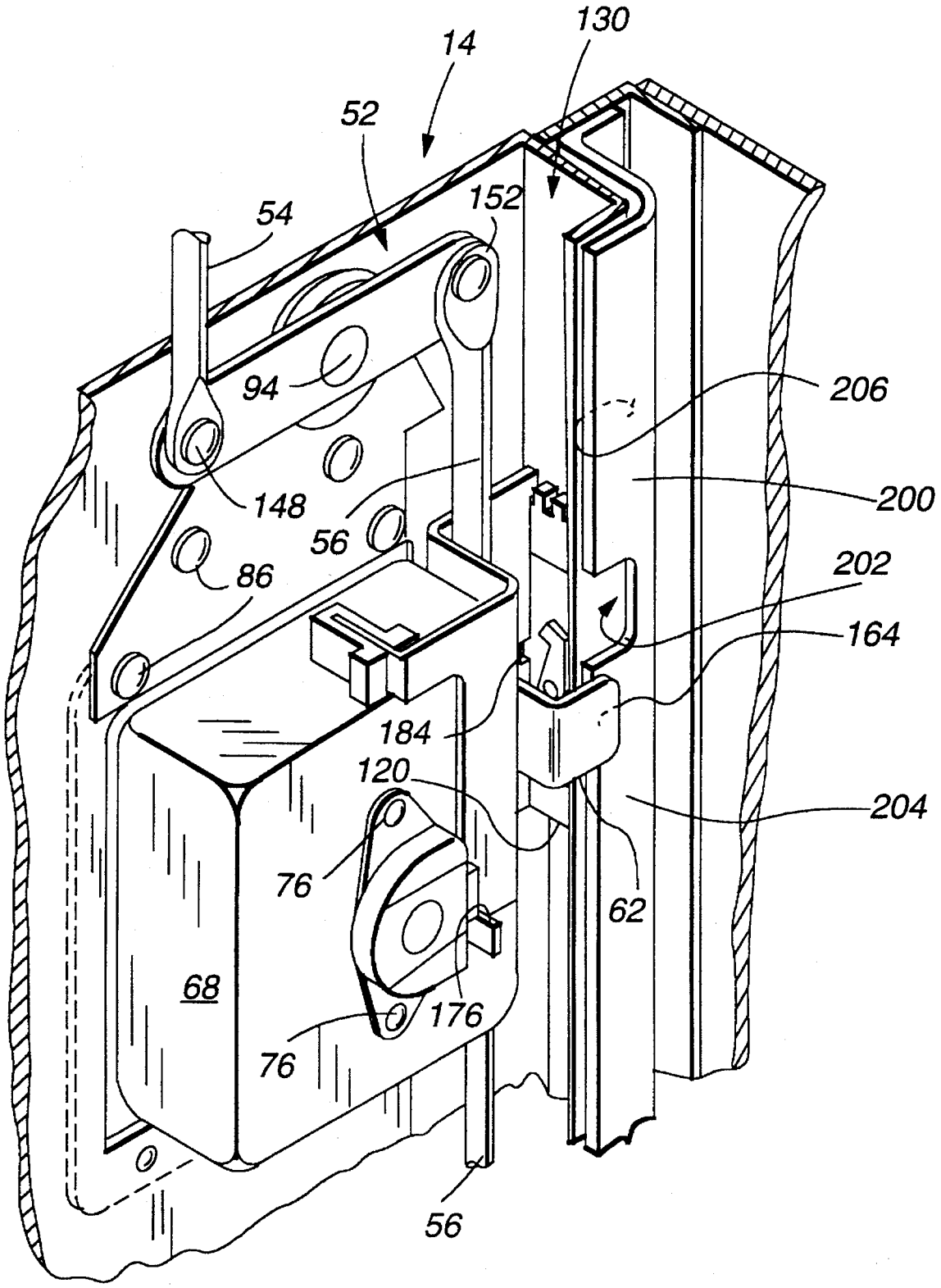
FIG. 7 is a cutaway, isometric view of the latch mechanism of the preceding figures showing in greater detail the use of the latching mechanism in conjunction with a continuous door stop having a latch pass through notch for allowing the center latch to pass therethrough when the latching mechanism is moved to the open position thereof.

Referring additionally now to FIG. 7, the latch mechanism 30 of the preceding figures is shown in conjunction with a single continuous door stop 200 utilized as an alternative to the door stop tab 158 and additional door stops 198 shown in the preceding figure. With respect to this illustration, structure previously described with respect to the preceding figures is like numbered and the foregoing description thereof shall suffice herefore.

In this illustration, the center latch 62 has its door stop surface 164 rejoining a door latch surface 204 of the continuous door stop 200. The continuous door stop 200 has a latch pass-through notch 202 through which the center latch 62 may pass upon the opening or unlatching of the latch mechanism 30 of the present invention. The door channel surface 206 serves to interact with the jamb tab 188 of the cam 180 in a manner similar to that performed by the door channel surface 160 of the door stop tab 158 illustrated with respect to FIG. 6.

With reference additionally now to FIGS. 8, 9 and 10, the latch mechanism 30 of the present invention is shown in its normally latched, or closed position with the cam 180 not having its bracket tab 182 biased into retention within the bracket notch 184 of the hasp bracket 50 as previously described.

With reference additionally to FIGS. 11 and 12, the latch mechanism 30 of the present invention is shown in its open, or unlatched, position whereupon the cam 180 is biased such that the bracket tab 182 thereof is retained within the bracket notch 184 of the hasp bracket 50 to thereby maintain the latch mechanism 30 in this position. As previously described, upon closure of the door 14 of the locker 10, the jamb tab 188 of the cam 180 causes cam 180 to pivot about pivot mount 186 releasing bracket tab 182 from retention within bracket notch 184 allowing the latch mechanism 30 to return to its normally closed, or latched, position.

While there have bene described above the principles of the invention in conjunction with specific apparatus, it is to be clearly understood that the foregoing description is made only by way of example and not as a limitation to the scope of the invention.

What is claimed is:

1. A latching mechanism for an enclosure having a generally box-like interior compartment and a hingedly attached door, said door having inner and outer surfaces and a periphery, said door periphery being surrounded by upper, lower and jamb portions of said enclosure, said door including an open-top recessed cup, said open-top of said cup terminating at said exterior surface of said door, and said cup having a wall surface that contains an aperture communicating with said interior compartment, said cup being displaced inwardly into said interior compartment from said interior surface of said door, said latching mechanism comprising:

a manually actuable bracket having an exposed portion extending through said aperture and disposed within said recessed cup, said exposed portion of said bracket presenting no protrusion beyond said outer surface of said door, said bracket having an unexposed portion that is contained within said interior compartment;

said bracket being manually actuatable by said exposed portion thereof and being movably retained adjacent to said interior surface of said door, said unexposed portion of said bracket including a center latch having a first latched position for engaging said center latch with said jamb portion, and having a second unlatched position for disengaging said center latch from said jamb portion;

a pivot bar pivotally secured about a substantially median point thereof and adjacent to said interior surface of said door, said pivot bar being coupled to said unexposed portion of said bracket for transforming a motion of said unexposed portion of said bracket that is induced by motion of said exposed portion of said bracket into a rotational motion of said pivot bar; and at least two radially extending lock rods pivotally affixed at proximal ends thereof adjacent to opposite ends of said pivot bar for transforming said rotational motion of said pivot bar into a translational motion of said lock rods, said lock rods having a first locked position in conjunction with said first latched position of said center latch for engaging said upper and lower portions of said enclosure adjacent to distal ends of said lock rods, and having a second unlocked position in conjunction with said second unlatched position of said center latch for disengaging said distal ends of said lock rods from said upper and lower portions of said enclosure.

2. The latching mechanism of claim 1 further comprising:

a cam in operative association with said unexposed portion of said bracket and said door, said cam having a first door open position for releasably retaining said center latch in said second unlatched position and said lock rods in said second unlocked position when said door is opened, and having a second door closed position allowing said center latch to move to said first latched position and said lock rods to move to said first locked position when said door is closed.

3. The latching mechanism of claim 2 wherein said cam is pivotally secured adjacent to said inner surface of said door and is force biased towards retention of a latch end thereof within a notch in said unexposed portion of said bracket when said can is in said first door open position.

4. The latching mechanism of claim 3 wherein said cam is released from retention of said latch end within said notch by pressure that is applied to an opposite end of said cam by interaction of said opposite end with said jam portion of said enclosure when said door is closed with said cam is in said first door open position.

5. The latching mechanism of claim 1 wherein said exposed portion of said bracket includes a hole for receiving a padlock shackle such that said exposed portion of said bracket is precluded from actuating said bracket by interference between said padlock shackle and said recessed cup when a padlock is in place.

6. The latching mechanism of claim 5 wherein said exposed portion of said bracket further comprises a finger grip for facilitating operation of said exposed portion of said bracket by an individual.

7. The latching mechanism of claim 1 further comprising:

a built-in lock mechanism secured within said recessed cup so as to not extend beyond said outer surface of said door, said lock mechanism having a bolt portion extending into said interior compartment adjacent to said unexposed portion of said bracket, said bolt portion being movable between a retracted state and an extended state such that said bracket is precluded from moving by interference of said unexposed portion of said bracket with said bolt portion in said extended state, and such that said bracket is not precluded from moving when said bolt portion is in said retracted state.

8. The latching mechanism of claim 1 wherein said jamb portion of said enclosure comprises a continuous door stop having a notch therein for allowing said center latch to pass therethrough when in said center latch is in said second unlatched position.

9. The latching mechanism of claim 1 wherein said jamb portion of said enclosure comprises a plurality of door stops having at least one interstitial gap therebetween for allowing said center latch to pass therethrough when said center latch is in said second unlatched position.

10. A method for latching an enclosure having a generally box-like interior compartment and a hingedly attached door, said door having inner and outer surfaces and a periphery that is surrounded by upper, lower and jamb portions of said enclosure, said door including a recessed cup that contains an aperture communicating between said inner and outer surfaces of said door, said cup being displaced inwardly into said interior compartment from said outer surface of said door, said method comprising the steps of:

disposing a lever within said aperture of said recessed cup such that an exposed portion of said lever is contained entirely within said cup, and such that an unexposed portion of said lever communicates with said interior compartment;

movably retaining a bracket adjacent to said interior surface of said door so as to be actuatable by said unexposed portion of said lever;

securing a center latch to said bracket, said center latch having a first latching position for engaging said jamb portion of said enclosure, and having a second unlatched position for disengaging said center latch from said jamb portion of said enclosure;

pivotally securing a pivot bar adjacent to said interior surface of said door at a substantially median point of said pivot bar;

operatively coupling said pivot bar to said bracket for transforming motion of said bracket as induced by motion of said exposed portion of said lever to a rotational motion of said pivot bar; and radially extending at least two lock rods pivotally affixed at proximal ends thereof adjacent to opposite ends of said pivot bar for transforming said rotational motion of said pivot bar to a translational motion of said lock rods, said lock rods having a first locked position in conjunction with said first latched position of said center latch for engaging said upper and lower portions of said enclosure adjacent distal ends of said lock rods, and said lock rods having a second unlocked position in conjunction with said second unlatched position of said center latch for disengaging said distal ends of said lock rods from said upper and lower portions of said enclosure whereby manual actuation of said exposed portion of said lever causes said center latch to move to said second unlatched position and said lock rods to move to said second unlocked position to enable said door to be opened.

11. The method of claim 10 further comprising the step of:

engaging a pivotally mounted cam in a notch in said bracket for releasably retaining said center latch in said second unlatched position and said lock rods in said second unlocked position when said door is opened; and disengaging said cam from said notch in said bracket to allow said center latch to move to said first latched position and said lock rods to move to said first locked position when said door is closed.

12. The method of claim 11 wherein said step of engaging is carried out by spring biasing a notch end of said cam toward said notch.

13. The method of claim 12 wherein said step of disengaging is carried out by applying pressure to an opposite end of said cam by interaction with said enclosure.

14. The method of claim 10 wherein said step of disposing further comprises the step of:

furnishing a hole in said exposed portion of said lever for receiving a padlock shackle whereby said unexposed portion of said lever is precluded from actuating said bracket by interference between said padlock shackle and said recessed cup when a padlock is in place.

15. The method of claim 10 wherein said step of movably retaining comprises the step of:

furnishing a built-in lock mechanism secured entirely within said recessed cup, said lock mechanism having a bolt portion extending into said interior compartment and movable between a retracted and an extended state whereby said bracket is precluded from moving by interference with said bolt portion in said extended state and said bracket is not precluded from moving when said bolt portion is in said retracted state.

16. The method of claim 10 wherein said step of operationally coupling comprises the step of: securing one of said lock rods to said bracket.

17. A locker including side, top, bottom and back panels forming a generally box-like interior compartment with a hingedly attached door having inner and outer surfaces and a door periphery that is surrounded by upper, lower and jamb portions of said locker, said door including a recessed cup having an aperture communicating between said inner and outer door surfaces and displaced inwardly into said interior compartment from said outer surface of said door, wherein the improvement, in combination, comprises:

a three-point latching mechanism including a lever extending through said aperture, said lever having an exposed portion disposed entirely within said recessed cup, and an unexposed portion communicating with said interior compartment of said locker;

a bracket actuatable by said unexposed portion of said lever movably retained adjacent to said interior surface of said door, said bracket including a center latch having a first latched position for engaging said jamb portion of said locker and a second unlatched position for disengaging said center latch from said jamb portion of said locker;

a pivot bar pivotally secured about a substantially median point thereof adjacent to said interior surface of said door, said pivot bar being coupled to said bracket for transforming a motion of said bracket that is induced by motion of said exposed portion of said lever to a rotational motion of said pivot bar; and at least two radially extending lock rods pivotally affixed at proximal ends thereof adjacent opposite ends of said pivot bar for transforming said rotational motion of said pivot bar to a translational motion of said lock rods, said lock rods having a first locked position in conjunction with said first latched position of said center latch for engaging said upper and lower portions of said locker adjacent distal ends of said lock rods, and said lock rods having a second unlocked position in conjunction with said second unlatched position of said center latch for disengaging said distal ends of said lock rods from said upper and lower portions of said locker.

18. The locker of claim 17 further comprising:

a cam in operative association with said bracket and said door, said cam having a first door open position for releasably retaining said center latch in said second unlatched position and said lock rods in said second unlocked position when said door is opened, and said cam having a second door closed position allowing said center latch to move to said first latched position and said lock rods to move to said first locked position when said door is closed.

19. The locker of claim 18 wherein said cam is pivotally secured adjacent to said inner surface of said door and wherein said cam is biased towards retention of a latch end of said cam within a notch in said bracket when said cam is in said first door open position.

20. The locker of claim 19 wherein said cam is released from retention within said notch by pressure applied to an opposite end of said cam by interaction of said opposite end with said locker when said door is closed.

21. The locker of claim 17 wherein said exposed portion of said lever includes a hole for receiving a padlock shackle such that said exposed portion of said lever is precluded from actuating said bracket by interference between said padlock shackle and said recessed cup when a padlock is in place.

22. The locker of claim 21 wherein said exposed portion of said lever further comprises a finger grip for facilitating manual operation of said lever by an individual.

23. The locker of claim 17 further comprising:

a built-in lock mechanism secured entirely within said recessed cup and having a bolt portion thereof extending into said interior compartment and movable between a retracted and an extended state such that said bracket is precluded from moving by interference with said bolt portion in said extended state, and such that said bracket is not precluded from moving when said bolt portion is in said retracted state.

24. The locker of claim 17 wherein said jamb portion of said locker comprises a continuous door stop having a notch therein for allowing said center latch to pass therethrough when said center latch is in said second unlatched position.

25. The locker of claim 17 wherein said jamb portion of said locker comprises a plurality of door stops having at least one interstitial gap therebetween for allowing said center latch to pass therethrough when said center latch is in said second unlatched position.

* * * * *